US011849897B2

(12) United States Patent
Gaus et al.

(10) Patent No.: US 11,849,897 B2
(45) Date of Patent: Dec. 26, 2023

(54) CLEANING SYSTEM AND METHOD FOR CLEANING ARTICLES TO BE CLEANED

(71) Applicant: MEIKO Maschinenbau Gmbh & Co. KG, Offenburg (DE)

(72) Inventors: Bruno Gaus, Offenburg (DE); Joachim Kupetz, Berghaupten (DE)

(73) Assignee: MEIKO MASCHINENBAU GMBH & CO. KG, Offenburg (DE)

( * ) Notice: Subject to any disclaimer, the term of this patent is extended or adjusted under 35 U.S.C. 154(b) by 0 days.

(21) Appl. No.: 17/288,233

(22) PCT Filed: Oct. 24, 2019

(86) PCT No.: PCT/EP2019/079059
§ 371 (c)(1),
(2) Date: Apr. 23, 2021

(87) PCT Pub. No.: WO2020/084071
PCT Pub. Date: Apr. 30, 2020

(65) Prior Publication Data

US 2022/0346623 A1 Nov. 3, 2022

(30) Foreign Application Priority Data

Oct. 24, 2018 (DE) ..... 102018218193.4

(51) Int. Cl.
*A47L 15/24* (2006.01)

(52) U.S. Cl.
CPC ..... *A47L 15/242* (2013.01); *A47L 15/245* (2013.01); *A47L 15/247* (2013.01)

(58) Field of Classification Search
None
See application file for complete search history.

(56) References Cited

U.S. PATENT DOCUMENTS 3,122,235 A 2/1964 Meeker et al.
3,550,755 A 12/1970 Noren
(Continued)

FOREIGN PATENT DOCUMENTS

CA 885576 A 9/1971
DE 4339111 A1 5/1994
(Continued)

OTHER PUBLICATIONS

PCT/EP2019/079059 International Search Report and Written Opinion, German, International Search Authority, dated Jan. 23, 2020, 15 pgs.
(Continued)

*Primary Examiner* — Rita P Adhlakha
(74) *Attorney, Agent, or Firm* — Ice Miller LLP

(57) ABSTRACT

A cleaning system (110) is proposed for cleaning articles (112) to be cleaned. The cleaning system (110) comprises:

a) at least one cleaning device (116), comprising at least one cleaning chamber (120) and at least one application device (122) for applying at least one cleaning fluid to the articles (112) to be cleaned in the cleaning chamber (120); and b) at least one transport system (118), comprising a plurality of transport segments (124) for receiving the articles (112) to be cleaned, wherein the transport segments (124) are guided such that they can be transported through the cleaning chamber (120) in circulation in a transport direction (114), wherein the transport system (118) also comprises at least one transport device (134) for driving the transport segments (124).

12 Claims, 2 Drawing Sheets

(56) References Cited

U.S. PATENT DOCUMENTS

| | | | | |
|---|---|---|---|---|
| 3,698,407 | A | 10/1972 | Noren | |
| 2007/0246071 | A1* | 10/2007 | Streb | A47L 15/248 134/61 |
| 2012/0037185 | A1* | 2/2012 | Ellingson | A47L 15/0005 134/25.2 |

FOREIGN PATENT DOCUMENTS

| | | | |
|---|---|---|---|
| DE | 102004049392 | A1 | 4/2006 |
| DE | 102004056052 | A1 | 6/2006 |
| DE | 102007025263 | A1 | 10/2007 |
| DE | 102011004853 | A1 | 8/2012 |
| DE | 102017121978 | A1 | 11/2017 |

OTHER PUBLICATIONS

PCT/EP2019/079059 International Search Report and Written Opinion, English Translation, International Search Authority, dated Jan. 23, 2020, 5 pgs.

* cited by examiner

CLEANING SYSTEM AND METHOD FOR CLEANING ARTICLES TO BE CLEANED

CROSS-REFERENCE TO RELATED APPLICATIONS

The present application is a Section 371 of International Patent Application Serial No. PCT/EP2019/079059, filed Oct. 24, 2019, and also claims the priority benefit of German Patent Application Serial No. 102018218193.4, filed Oct. 24, 2018, the text and drawings of which are hereby incorporated by reference in their entireties.

TECHNICAL FIELD

The invention concerns a cleaning system and a method for cleaning articles to be cleaned. Cleaning systems and methods of said type may be used for example in the field of dishwashing technology, in particular in the field of commercial dishwashing. The invention may be used in particular in catering facilities in which articles to be cleaned, for example trays, crockery and cutlery, must be cleaned in large quantities. All other areas of use are however conceivable in principle.

TECHNICAL BACKGROUND

A plurality of cleaning devices, also called cleaning machines, are known in the prior art which can clean and/or disinfect articles to be cleaned. The design of these cleaning devices as a whole depends greatly on the various peripheral conditions, such as for example the nature of the articles to be cleaned, the dirt, the throughput rate or similar conditions. As an example, reference may be made to cleaning devices which are described for example in DE 10 2004 056 052 A1 or DE 10 2007 025 263 A1.

In many cases, in catering facilities, cleaning devices are combined with transport devices or transport systems for automatically delivering and/or discharging the articles to be cleaned. Thus for example, in many facilities for community services, such as for example canteens in schools, hospitals or other institutions which cater for many people, cleaning systems are provided in which trays with dirty crockery and cutlery are placed on a transport belt. In this way, the articles to be cleaned are transported to the actual cleaning device, such as for example a dishwasher. There, operating personnel usually sort the articles, dispose of waste, and supply the crockery, cutlery and trays in suitable fashion to the cleaning device, for example a belt transport dishwasher, a basket transport dishwasher or also a pass-through dishwasher, for example in the form of a hood dishwasher. In many cases, despite the transport system, manual work is still required for sorting and input of the dirty articles to be cleaned into the cleaning device, and/or also for removing the cleaned articles from the cleaning device.

Here, in many cases, it is a technical and also organizational challenge that the dirty articles to be cleaned do not occur evenly. In particular because of group dynamics, timetables or similar circumstances beyond the range of influence of the canteen, often load peaks occur but also times at which there are few or no articles to be cleaned. This constitutes a substantial challenge for planning personnel needs and also planning the design of the cleaning device. Thus the design of the system and personnel planning must normally be configured so that the number of personnel rises for load peaks, but under certain circumstances outside load peaks this may lead to under-utilization of personnel. Personnel planning and the design of the cleaning device must therefore in many cases be over-dimensioned.

DE 10 2017 121 978 A1 describes a dishwasher in the form of a commercial utensil washer or dishwasher configured as a programmable machine, which is designed as a hood or pass-through dishwasher and has a treatment chamber with at least one washing system designed as a recirculation system. To ensure that the actually achievable utilization of the machine can be optimized, with simultaneous load relief on the dishwashing personnel, according to the invention it is provided that a loading/unloading device is assigned to the dishwasher for preferably optional automatic loading of dishes into the treatment chamber and/or for preferably optional automatic unloading of dishes from the treatment chamber.

DE 4339111 A1 describes a dishwasher. To persistently lower the consumption of water, energy and washing agent, the dishes are washed in individual washing baskets in cyclic operation, wherein the cycles of the dishwasher need only be operated in their respective time interval within the washing program. A conveyor belt for the crockery baskets is actuated by means of corresponding switches such that the crockery remains in the region of a washing zone during the washing process.

DE 10 2004 049 392 A 1 describes a method for transporting articles to be cleaned through a pass-through dishwasher, and also describes a pass-through dishwasher. The pass-through dishwasher comprises a washing zone, a rinsing zone and drying zone. The articles to be cleaned are cleaned in the washing zone, rinsed in the rinsing zone and dried in the drying zone. Transport devices are provided with which the articles to be cleaned are transported in the conveying direction with optimal transport speed for the process steps taking place in the respective zones.

Despite the advantages achieved with these devices and methods, the technical and organizational challenges described above usually persist. Thus with conventional cleaning systems, the transport devices are extremely inflexible and usually unable to adapt to the different peripheral conditions, in particular to suddenly occurring load peaks, backlogs during loading, or changing requirements with respect to the nature of the dirt or the articles to be cleaned. In load peaks therefore, usually only the transport speed of the transport device may be adapted, for example by slowing down the transport or stopping it completely. These measures usually then apply to the entire cleaning system. Therefore, for many cleaning systems, personnel planning must still be dimensioned so that staff numbers increase in each case of a peak load. Operating personnel must usually, in particular in load peaks, sort crockery particularly carefully and distribute it on the conveyor belt in order to make optimum use of the limited capacity of the cleaning device. When the load level falls, less careful sorting and distribution is indeed necessary but the operating staff must still be retained in order to be able to react again directly when new load peaks occur. This retention of over-capacity in personnel and usually machines may lead to unnecessary additional cost in procurement and operation of the cleaning device. Also, the use of cyclic cleaning devices, such as for example programmable machines e.g. in the form of hood or pass-through dishwashers, is usually not possible or only possible if the entire cleaning system including the transport device is operated cyclically.

OBJECT OF THE INVENTION

It would therefore be desirable to provide a cleaning system and method for cleaning articles to be cleaned, in particular articles to be cleaned in the field of canteens, which at least largely avoid the disadvantages of known devices and methods of said type. In particular, the cleaning system and the method allow a more flexible personnel planning with respect to operating personnel and a more flexible design of the equipment, and preferably a reduction in the use of operating personnel.

DISCLOSURE OF THE INVENTION

This object is achieved by a cleaning system and a method for cleaning articles to be cleaned with the features of the independent claims. Advantageous refinements, which may be implemented individually or in arbitrary combination, are presented in the dependent claims.

In the text which follows, the terms "have", "comprise", "contain" or "include" or arbitrary grammatical derivatives thereof are used in non-exclusive fashion. Accordingly, these terms may refer both to situations in which, in addition to the features introduced by these terms, no further features are present, and to situations in which one or more further features are present. For example, the expression "A has B", "A comprises B", "A contains B" or "A includes B" may refer both to situations in which, apart from B, no further element is present in A (i.e. a situation in which A consists exclusively of B), and also to situations in which, in addition to B, one or more further elements are present in A, for example element C, elements C and D, or further elements.

It is furthermore pointed out that the terms "at least one" and "one or more" and grammatical derivatives of these terms, when used in connection with one or more elements or features and intended to express that the element or feature may be provided in the singular or plural, are usually only used once, for example on the first introduction of the feature or element. In the subsequent repeated mention of the feature or element, the corresponding term "at least one" or "one or more" is not normally used, without restricting the possibility that the feature or element may be provided in the singular or plural.

Furthermore, in the text which follows, the terms "preferably", "in particular", "for example" or similar terms are used in connection with optional features, without alternative embodiments being thereby restricted. Thus features which are introduced by these terms are optional features, and it is not intended that these features restrict the scope of protection of the claims and in particular of the independent claims. Thus the invention, as the person skilled in the art will know, may also be implemented using other embodiments. Similarly, features which are introduced by "in one embodiment of the invention" or by "in an exemplary embodiment of the invention" are to be understood as optional features, without alternative embodiments or the scope of protection of the independent claims being thereby restricted. Furthermore, these introductory expressions do not restrict any possibilities of combining the features introduced thereby with other features, be these optional or non-optional features.

In a first aspect, a cleaning system is proposed for cleaning articles to be cleaned. This cleaning system comprises as components at least one cleaning device and at least one transport system.

The term "cleaning system" as used here is a broad term which should be given its usual and common meaning as understood by the person skilled in the art. The term is not restricted to a particular or adapted meaning. The term "system" in general may mean a device or a group of interacting devices which are designed to fulfil at least one common purpose. The term "cleaning system" may accordingly, without restriction, refer in particular to a system which is configured for implementing at least one cleaning process, i.e. for completely or partially freeing articles to be cleaned from adhering dirt and/or microbial contamination.

The term "transport system" as used here is a broad term which should be given its usual and common meaning as understood by the person skilled in the art. The term is not restricted to a particular or adapted meaning. The term may, without restriction, refer in particular to a system in the sense of the above definition which serves for transport of one or more elements or objects, such as for example, in the present case, in particular the transport of articles to be cleaned.

The term "cleaning device" as used here is a broad term which should be given its usual and common meaning as understood by the person skilled in the art. The term is not restricted to a particular or adapted meaning. The term may, without restriction, refer to a device which is designed to at least partially free articles to be cleaned from adhering macroscopic or also microscopic dirt or similar contamination. In addition, optionally a disinfection action may be performed. The cleaning device, as will be explained in more detail below, may in particular be configured as a dishwasher, in particular as a dishwashing machine. The dishwasher may for example be a single-chamber dishwasher, in particular a commercial single-chamber dishwasher with multi-cycle washing system, or as a transport dishwasher, in particular as a belt transport dishwasher and/or a basket transport dishwasher. Examples are explained in more detail below.

The term "articles to be cleaned" as used here is a broad term which should be given its usual and common meaning as understood by the person skilled in the art. The term is not restricted to a particular or adapted meaning. The term may, without restriction, refer in particular to arbitrary objects which are to be cleaned by means of the cleaning device. One object may be cleaned or several objects may be cleaned simultaneously or sequentially. In particular, the articles to be cleaned may be objects which are used directly or indirectly for the preparation, storage or distribution of food, i.e. for example crockery, cutlery, trays, dishes, glasses, pots, pans or similar objects.

Accordingly, the cleaning device may in particular be configured as a dishwashing machine, for example as a dishwasher for commercial use in large kitchens or canteens of community facilities. Other embodiments of the cleaning device and/or articles to be cleaned are in principle possible.

The cleaning device comprises at least one cleaning chamber and at least one application device for applying at least one cleaning fluid to the articles to be cleaned in the cleaning chamber. The cleaning chamber may be at least partially closed or closable.

The term "cleaning chamber" as used here is a broad term which should be given its usual and common meaning as understood by the person skilled in the art. The term is not restricted to a particular or adapted meaning. The term may, without restriction, refer in particular to a fully or partially closed chamber, inside which the cleaning process can be carried out completely or partially. The cleaning chamber may in particular comprise at least one housing which fully or partially surrounds the cleaning chamber. A single cleaning chamber may be provided, or in principle several cleaning chambers may be provided, for example sequentially. The cleaning chamber may for example have at least one opening for loading the cleaning chamber with the articles to be cleaned. For example, this may be an opening with a hatch arranged on a front side of the cleaning chamber and/or a top side of the cleaning chamber. Alternatively, hoods may be used for closing the cleaning chamber, for example in the context of so-called hood dishwashers. Again alternatively, the cleaning chamber may be configured for example fully or partially as a tunnel, for example in the context of so-called pass-through dishwashers or transport dishwashers, in particular as a tunnel with an inlet opening and an outlet opening. Other embodiments are in principle also possible.

The term "application device" as used here is a broad term which should be given its usual and common meaning as understood by the person skilled in the art. The term is not restricted to a particular or adapted meaning. The term may, without restriction, refer in particular to a fundamentally arbitrary device, by means of which the cleaning fluid can be applied to the articles to be cleaned inside the cleaning chamber. The application device may in particular, as will be explained in more detail below, comprise at least one nozzle system. Furthermore, the application device may comprise at least one pump and at least one line system for supplying cleaning fluid to the nozzle system. For example, a nozzle system and a line system may be provided for applying a cleaning fluid from a tank, and at least one corresponding pump. Alternatively or additionally, also for example at least one nozzle system may be loaded directly from a supply line without a pump being necessary. In the cleaning device, one or more cleaning zones may be provided through which, for example, articles to be cleaned pass sequentially. Thus for example a single cleaning zone may be provided, wherein the cleaning device is configured to carry out a cleaning program by means of the applying device, wherein the articles to be cleaned are received stationarily in the cleaning chamber and cleaning fluid is successively applied to the articles to be cleaned in different ways in one or more cleaning steps of the cleaning program. Alternatively, the articles to be cleaned are also transported successively through several cleaning zones in which a different type of application of cleaning fluid takes place, for example one or more cleaning zones selected from the group comprising a preliminary clearing zone, a washing zone, a flushing or rinsing zone, wherein the latter may also be subdivided into a pump-rinsing zone and a downstream fresh-water rinsing zone. Furthermore, at least one drying step may be provided, which for example, in the case the stationary reception of the articles to be cleaned in the one chamber, may take place after the application of cleaning fluid, or which for example, in the transport dishwasher, may take place in a drying zone downstream of the fluid cleaning zones.

The term "cleaning fluid" as used here is a broad term which should be given its usual and common meaning as understood by the person skilled in the art. The term is not restricted to a particular or adapted meaning. The term may, without restriction, refer in particular to a fluid which can deploy a cleaning effect on contact with the articles to be cleaned. In particular, the cleaning fluid may be a watery fluid, for example water and/or water with one or more additives, for example with one or more cleaning concentrates and/or rinsing agents and/or disinfection agents. The cleaning device may be configured to use a single cleaning fluid or also to use a combination of several cleaning fluids. If several cleaning fluids are provided, the application of different cleaning fluids to the articles to be cleaned may take place simultaneously or also sequentially. Thus the articles to be cleaned may, for example, remain stationary inside the cleaning chamber and the different cleaning fluids and/or cleaning liquids may be applied successively to the articles to be cleaned. Alternatively, the articles to be cleaned, as stated above, may also be transported sequentially through several cleaning zones in which for example different types of cleaning fluid and/or cleaning fluids of different purity grades are applied to the articles to be cleaned. Different purity grades may be produced for example by a cascade overflow between different tanks of the cleaning device, wherein preferably a purity grade increases in the transport direction. Also pump systems are known and may be used here, which control the fluid balance and purity grade between individual tanks of the cleaning device.

The transport system comprises a plurality of transport segments for receiving the articles to be cleaned. The transport segments are configured, in particular guided, such that they can be transported through the cleaning chamber in circulation in a transport direction. The cleaning device furthermore comprises at least one transport device for driving the transport segments. The at least one transport device may in particular run in circulation through the cleaning chamber. The transport segments may in particular be able to be automatically coupled to the transport device, in particular reversibly. Thus the transport segments in particular can be automatically coupled to the transport device and automatically decoupled from the transport device. Alternatively however, a fixed coupling of the transport segments to the transport device is possible.

The term "transport segment" as used here is a broad term which should be given its usual and common meaning as understood by the person skilled in the art. The term is not restricted to a particular or adapted meaning. The term may, without restriction, refer to a carrier device which is configured to transport one or more elements or objects, in particular as part of a transport system. The transport segments may in particular each comprise at least one element selected from the group consisting of a portion of a link chain for receiving articles to be cleaned, a belt portion of a transport belt for receiving articles to be cleaned. The transport segments may for example be guided by at least one guide element, generally also known as a guide, for example by means of a transport rail which can guide the transport segments through the cleaning chamber in circulation in a transport direction or against the transport direction. The transport direction may for example be predefined by the guide element. For example, several transport segments may be received in or on the at least one guide element, so that they can be guided preferably independently of one another in the guide element or by the guide element. In particular, the transport segments may comprise a plurality of fingers in or between which the articles to be cleaned may be inserted. In particular, the transport system may be a belt transport system. In particular, the cleaning device may comprise a pass-through dishwasher and the belt transport system may be adaptable to a discontinuous operation of the pass-through dishwasher. In the case of automated loading and/or automated unloading of the belt transport system, the belt transport system may offer advantages over the crockery baskets known from the prior art. Crockery baskets known from the prior art usually have dimensions of 500 mm×500 mm, or 600 mm×500 mm with respect to a length and width of the crockery baskets. The transport segments may be designed longer than the crockery baskets known from the prior art. In particular, the transport segments may have a length of at least 700 mm, preferably at least 800 mm, preferably at least 900 mm and preferably at least 1000 mm. The belt transport system may be configured such that transport segments situated outside the cleaning chamber can be loaded with the articles to be cleaned and/or unloaded while the program is running.

Furthermore, the transport segments may comprise at least one plate-like carrier element for receiving articles to be cleaned.

The term "guide" or grammatical derivatives thereof may in particular refer to a process in which a movement of another element is restricted in its degrees of freedom. For example, the guide may comprise predefinition of a movement track of at least one guided element.

The term "in circulation" as used here is a broad term which should be given its usual and common meaning as understood by the person skilled in the art. The term is not restricted to a particular or adapted meaning. The term may, without restriction, refer in particular to the property of a process to be repeated iteratively. In connection with the transport path of the transport segments through the cleaning chamber, and in connection with the path of the transport device through the cleaning chamber, the term may in particular be understood to mean that the transport or movement of the transport device within the cleaning chamber takes place from an inlet or input of the cleaning chamber to an outlet or output of the cleaning chamber, and outside the cleaning chamber again from the outlet or output to the inlet or input, so that an uninterrupted process can be carried out. For example, the guide of the transport segments may comprise at least one continuous guide element, for example at least one continuous rail, by means of which the transport segments can be guided from an inlet or input of the cleaning chamber to an outlet or output of the cleaning chamber, and outside the cleaning chamber again from the outlet or output to the inlet or input. With respect to the at least one transport device, which for example may comprise at least one drive, for example at least one drive chain and/or at least one drive belt, the circulation may take place for example such that the transport segments are or can be coupled to the transport device at each site at which they can be guided by the guide element. Thus the at least one drive chain and/or the at least one drive belt may be guided for example so as to run partially inside the cleaning chamber and partially outside the cleaning chamber, such that a circulation of these elements inside the cleaning chamber takes place from an inlet or input to an outlet or output, and outside the cleaning chamber from the outlet or output to the inlet or input. The term "circulation" does not necessarily imply that the element guided in circulation actually describes a circular path, but describes preferably a closed path. The closed path may, in addition to a circular path, also for example be an oval path, a rectangular path, a rectangular path with rounded corners, a polygonal path or a polygonal path with rounded corners. Thus in general, the transport segments may be guided such that they can be transported on a closed path through the cleaning chamber, wherein part of the closed path may run outside the cleaning chamber and part of the closed path inside the cleaning chamber. Correspondingly, the transport device may run on a closed path through the cleaning chamber, wherein a part of the closed path runs through the cleaning chamber and a part of the closed path runs outside the cleaning chamber.

The term "transport device" as used here is a broad term which should be given its usual and common meaning as understood by the person skilled in the art. The term is not restricted to a particular or adapted meaning. The term may, without restriction, refer in particular to a device which is configured to transport at least one other device or at least one other element, and/or drive a movement of the other device or other element. The transport device may in particular comprise at least one drive element, for example at least one drive element running in circulation through the cleaning chamber. In particular, the transport device, for example the drive element, may comprise at least one element selected from the group consisting of a drive chain, a drive belt, a ratchet transport, a lifting cylinder.

The term "couple" as used here, and grammatical derivatives thereof, are broad terms which should be given their usual and common meaning as understood by the person skilled in the art. The term is not restricted to a particular or adapted meaning. The term may, without restriction, refer in particular to a process in which an element is connected to another element, in particular temporarily or reversibly. Here, the movement of the one element may for example be linked to the movement of the other element, and/or caused by or predefined by the movement of the other element. The term "can be coupled" may accordingly be understood as a structural configuration allowing the two elements to be coupled to one another. Thus for example, the one element and/or the other element may comprise at least one coupling device via which coupling can take place. Thus in particular, as explained in more detail below, the transport segments may each comprise a coupling device which can be coupled, in particular reversibly, to the transport device, and/or the transport device may comprise at least one coupling device which can be coupled, in particular reversibly, to the transport segments. Accordingly, the term "decouple" as used here, and grammatical derivatives thereof, are broad terms which should be given their usual and common meaning as understood by the person skilled in the art. The term is not restricted to a particular or adapted meaning. The term may, without restriction, refer in particular to a process in which a connection of one element to another element is released. Accordingly, the above-described at least one optional coupling device of the transport segments and/or the at least one optional coupling device of the transport device may be configured such that the above-described coupling can be released again. The coupling device may for example cause at least one mechanical and/or electromechanical engagement which can achieve the described coupling reversibly. Thus a mechanical engagement may take place for example via at least one coupling element selected from the group comprising a hook, an eye, a carrier, a pawl, a bolt and associated bore, a toothing, groove and tongue or tine, or similar devices which for example can engage in a force-fit and/or form-fit connection. Alternatively or additionally, an electromechanical engagement may take place, for example by a coupling element in the form of an electromagnet.

The term "automatic" as used here is a broad term which should be given its usual and common meaning as understood by the person skilled in the art. The term is not restricted to a particular or adapted meaning. The term may, without restriction, refer in particular to the property of the process or an activity to take place without human intervention, for example depending on the presence of one or more conditions. Thus the automatic process may take place for example depending on whether one or more predefined conditions are fulfilled or not fulfilled.

In the present case, the automatic coupling and/or automatic decoupling of the transport segments to and/or from the transport device may take place for example depending on fulfilment of at least one condition, for example at least one condition selected from the group consisting of: the respective transport segment is situated in at least one predefined site; the cleaning system is in a predefined system state; at least one sensor supplies at least one corresponding sensor signal; at least one controller of the cleaning system supplies at least one coupling signal and/or at least one decoupling signal; the cleaning device has completed a cleaning program; the cleaning device reports readiness to begin a cleaning program.

The proposed cleaning system addresses the problems described above. In particular, the process of loading the cleaning system with articles to be cleaned can now be at least largely decoupled from the actual cleaning process inside the cleaning device, so that for example one or more transport segments may be loaded with the articles to be cleaned outside the cleaning device and hence outside the cleaning chamber, while for example, independently thereof, at least one transport segment may be present inside the cleaning chamber while cleaning fluid may be applied to the articles to be cleaned on the at least one transport segment. The latter transport segment may be transported with a different speed from the transport segment outside the cleaning chamber, wherein even a complete stoppage of transport inside the cleaning chamber may take place, for example with cyclic cleaning devices such as for example programmable machines such as e.g. pass-through dishwashers in the form of hood dishwashers. Thus for example even suddenly occurring load peaks may be countered, since transport segments outside the cleaning chamber can be loaded and/or unloaded independently of the processes inside the cleaning chamber. A more flexible personnel planning is also possible since for example loading may take place automatically, wherein a travel distance before the cleaning chamber may serve for example as a buffer so operating personnel need not be constantly on site.

These advantages can be further emphasized and improved in various ways. Thus the cleaning system may in particular comprise a plurality of transport devices, for example a to plurality of transport belts and/or a plurality of transport chains. These transport devices may in particular be able to be operated independently of one another, for example they can be operated at different speeds independently of one another, including the possibility that at least one of the transport devices can be stopped while at least a further one of the transport devices continues to run. For example, each of the transport devices may run in circulation through the cleaning chamber, or at least two of the transport devices may run in circulation through the cleaning chamber.

The transport devices may be used in various ways. Thus for example, the respective at least one transport segment may be coupled selectively to at least one first transport device or to at least one second transport device. The term "selectively" as used here is a broad term which should be given its usual and common meaning as understood by the person skilled in the art. The term is not restricted to a particular or adapted meaning. The term may, without restriction, refer in particular to the fact that, preferably automatically, a first option or a second option is to be implemented. For example, an automatic coupling of the transport segments to the at least one first transport device or to the at least one second transport device may again take place either under control by a controller, or depending on whether at least one predefined or predefinable condition is fulfilled for the respective at least one transport segment and/or for the cleaning system. For example, the coupling and/or decoupling of the transport segments to and/or from the at least one first transport device or the at least one second transport device may be dependent on at least one condition selected from the group consisting of: the respective transport system is situated in at least one predefined location; the cleaning system is in a predefined system state; at least one sensor supplies at least one corresponding sensor signal; at least one controller of the cleaning system supplies at least one coupling signal and/or at least one decoupling signal; the cleaning device has completed a cleaning program; the cleaning device reports readiness to begin a cleaning program. In particular, the cleaning device may be configured such that the respective transport segment can be coupled alternatively either to the at least one first transport device or to the at least one second transport device. Thus the respective transport segment may for example be coupled to the first transport device in at least one first region, and to the at least one second transport device in at least one second region. Also, more than two transport devices may be provided.

The transport devices may, as stated above, in particular be driven independently of one another. In particular, the transport devices may be drivable with different speeds, for example in that they are driven by different drive systems such as for example different motors, and/or in that they are connected to a motor via different couplings or different gear mechanisms.

As stated above, the transport devices may in particular be used respectively in different regions of the cleaning system for transport of the transport segments. Thus for example, the cleaning system may be configured such that the transport segments are each coupled to at least one first transport device outside the cleaning chamber and coupled to at least one second transport device inside the cleaning chamber. Alternatively or additionally to the division of the regions of the transport system into regions inside and outside the cleaning chamber, further or other divisions may be made, for example divisions into two or more of the following regions: a delivery region in which the articles to be cleaned are placed on the transport system directly or indirectly, for example by means of one or more transport baskets; a cleaning region in which the articles to be cleaned are cleaned inside the cleaning chamber; a transport region in which the articles to be cleaned are transported from a delivery region to the cleaning region; different cleaning zones inside the cleaning chamber; an output region in which the cleaned articles are removed from the transport system; a transport region in which the cleaned articles are transported from the cleaning chamber to the output region.

As stated above, a possible advantage of the configuration of the proposed cleaning system is that the cleaning device can also be operated cyclically. Thus the cleaning device may be configured for example such that, within the cleaning chamber, the articles to be cleaned remain stationary for a predefined or predefinable time and are there cleaned stationarily, while for example, independently of this cleaning, outside the cleaning chamber, further articles to be cleaned can be placed on the transport system and/or removed from the transport system. To this end, for example, one or more transport segments are arranged so as to be movable outside the cleaning chamber, while for example at least one transport segment remains stationary inside the cleaning chamber during the application and/or is moved at a different speed from the at least one transport segment situated outside the cleaning chamber. This may be advantageous for example if the cleaning device comprises at least one cyclic cleaning device, for example at least one programmable machine in which the articles to be cleaned remain stationary in the cleaning chamber during a cleaning program. Alternatively, the cleaning device may however also comprise, for example, at least one transport dishwasher in which for example transport takes place through one or more cleaning zones, wherein the segmenting by the transport segments and the possibility of coupling to different transport devices may lead to the possibility of selecting a transport speed inside the cleaning zones at least largely independently of the transport speed of transport segments outside the cleaning chamber and/or in other cleaning zones. If at least one first transport device and at least one second transport device are provided, then for to example the second transport device may be operated discontinuously and be configured to halt each transport segment inside the cleaning chamber for a predefined or predefinable duration.

The cleaning system may in particular be configured to open the cleaning chamber on a transfer of the transport segments from the first transport device to the second transport device, i.e. on decoupling from the first transport device and coupling to the second transport device, in order to introduce the respective at least one transport segment into the cleaning chamber. Thus the cleaning system may for example comprise at least one opening device. For example, this at least one opening device may be selected from the group consisting of a flap, a slider, a hood, a door. Other embodiments are also possible. For example, a first opening device may be provided at an inlet to the cleaning chamber, and a second opening device may be provided at an outlet from the cleaning chamber. Alternatively however, also a single opening device may be provided for both the inlet and for the outlet, for example if a hood which closes the cleaning chamber is opened or closed. The cleaning system may furthermore be configured to open the cleaning chamber again on a transfer of the respective at least one transport segment from the second transport device to the first transport device, in order to discharge the respective at least one transport segment from the cleaning chamber. Alternatively, a transfer may take place from the second transport device to a third transport device, for example also when the cleaning chamber is opened again, in particular after termination of a cleaning program.

As stated above, the transport segments may be coupled, in particular reversibly, to the at least one transport device. Alternatively, the transport segments may for example also be coupled fixedly to one or more transport devices. The transport segments and the transport devices may also be divided into two or more groups, which may be arranged for example alternately. In this way, for example, two or more drive speeds for the transport segments may be implemented, wherein the drive speeds as a whole may in particular be synchronized.

Thus, for example, alternately transport segments of a first transport segment group and of a second transport segment group may be present in the cleaning chamber, and either remain there stationarily during the cleaning process, such as for example in programmable machines, or be transported through the cleaning chamber, such as for example in transport dishwashers. In particular, the transport system may comprise at least one first transport segment group and at least one second transport segment group, wherein the first transport segment group and the second transport segment group each comprise at least one transport segment. For example, a first transport device may be assigned to the first transport segment group and a second transport device may be assigned to the second transport segment group.

The at least one transport segment of the first transport segment group may in particular be fixedly coupled to the first transport device, and the transport segment of the second transport segment group may be fixedly coupled to the second transport device. In this case, a coupling and decoupling are in principle not required. Alternatively, the transport segments of the first and second transport segment group may however also be able to be coupled reversibly to their respective transport devices.

For example, the first transport segment group and the second transport segment group may each have a plurality of transport segments. These may be arranged alternately. Thus the transport segments of the first transport segment group and of the second transport segment group may be arranged alternately. This alternating arrangement may for example lead to either a transport segment of the first transport segment group or a transport segment of the second transport segment group being present in the cleaning chamber.

The first transport device and the second transport device may in particular be driven in temporal synchrony. This synchronization may in particular be structured such that the transport segments of the first transport segment group and of the second transport segment group do not collide. Furthermore, the respective speed of the transport devices may be adapted to the function, for example loading, cleaning in the cleaning chamber, unloading.

As stated above, the transport segments may in particular be able to be automatically coupled to the transport device and decoupled from the transport device. This automatic coupling or automatic decoupling may take place for example depending on at least one control signal from at least one controller of the cleaning system, and/or alternatively or additionally, also depending on the presence of at least one condition as stated above. For example, because of the transport and the movement of the transport segments, at least one coupling element of the transport device may be coupled to a coupling element of the transport device at one specific site, and be detached from the coupling element of the transport device at another specific site. This may take place for example by means of a corresponding guide which, at one specific site, moves the respective transport segment relative to the transport device up to the transport device in order to achieve coupling and, at another specific site, moves the respective transport segment relative to the transport device away from the transport device in order to achieve a decoupling. For the person skilled in the art, there are numerous possibilities for achieving an automatic coupling and/or automatic decoupling, which can be implemented in principle on the basis of his specialist knowledge.

The transport segments and the transport device may in particular be configured such that the respective transport segment is automatically coupled to the transport device in at least one predefined or predefinable portion of a travel distance of a circulation of the transport device, and automatically decoupled from the transport device in at least one further predefined or predefinable portion of the travel distance of the circulation of the transport device. If several transport devices are present, the transport segments may for example each be coupled to these transport devices in different portions, so that for example the respective transport segment is in each case coupled only to one transport device.

As stated above, the cleaning system may in particular comprise at least one guide element for guiding the transport segments. In particular, the cleaning system may comprise at least one guide rail. The transport segments are transportable to the cleaning chamber on the guide rail in circulation in the transport direction.

As stated above, the cleaning system may comprise a plurality of transport segments, for example two, three, four or more transport segments. These transport segments may in particular be movable independently of one another. Accordingly, for example, a distance between two adjacent transport segments may be designed variably. The transport segments may in particular be arranged spaced relative to one another, for example spaced variably, such that at least one intermediate space occurs between two of the transport segments along the travel length of the transport device. This intermediate space may for example be variable. This intermediate space may for example serve as a buffer to compensate temporarily for different transport speeds of the transport segments, for example resulting from a different coupling to different transport devices. As stated above, this may be used in particular to allow the use of cyclic cleaning devices in the cleaning system and/or to absorb and compensate for brief load peaks. In particular, a total of the lengths of all transport segments along the travel distance may be smaller than the length of the travel distance, in particular by a factor of 0.8 or less, in particular by a factor of 0.7 or less, for example by a factor of 0.5 to 0.66, or even less than 0.5.

The transport segments may in particular each comprise a plurality of receiving compartments for the articles to be cleaned. These receiving compartments may for example comprise a plurality of fingers in which the articles to be cleaned may be inserted or placed directly or indirectly. Furthermore, these fingers may also for example be used to engage in one or more transport baskets in which the articles to be cleaned are received. The cleaning system may thus, for example, use the principle of known belt transport dishwashers or also the principle of known basket transport dishwashers.

The at least one transport device, as stated above, may be structured in various ways. In particular, the transport device may comprise at least one device selected from the group consisting of a transport belt, a transport chain, a plurality of transport rollers, a ratchet drive. In general, the transport device may comprise at least one moved element to which the transport segments may be coupled and from which they may also be decoupled again.

The transport segments and the transport device may in particular have co-operating coupling elements. The coupling elements may in particular be elements which are configured for coupling to one another or decoupling from one another. Thus for example, complementary coupling elements may be provided on the transport segment and the transport device respectively. Alternatively, for example, also at least one coupling element may be provided only on the transport segment and no coupling element on the transport device, or no coupling element may be provided on the transport segment and only at least one coupling element on the transport device.

In particular, the cleaning system may comprise at least one spatial region, for example at least one belt portion or at least one portion of an entire transport path of the transport segments in the circuit, in which the transport device is moved relatively away from a guide of the transport segments such that decoupling takes place. Alternatively or additionally, the cleaning system may have at least one spatial region in which the transport device is moved relatively towards the guide of the transport segments so that coupling takes place.

The coupling elements may in particular be configured to be fully or partly movable. The coupling elements may in particular comprise at least one element selected from the group consisting of a carrier and a transport hook. As stated above, alternatively or additionally, other coupling elements may also be provided.

The cleaning system may in particular comprise at least one dishwashing machine. In particular, this may be a commercial dishwasher, in particular a dishwasher which has at least two separate tanks for cleaning fluid. Transport dishwashers may be used or, as stated above, also cyclic dishwashers, i.e. dishwashers in which the articles to be cleaned remain temporarily stationary at one location during the cleaning process. In particular, this may be a programmable machine on which a cleaning program runs while the articles to be cleaned remain stationary in the cleaning chamber. The dishwasher may in particular be selected from the group consisting of a basket transport dishwasher, a belt transport dishwasher, a pass-through dishwasher. Other embodiments are however possible.

The cleaning chamber may in particular be configured completely or partially as a cleaning tunnel. The cleaning tunnel may for example have at least one inlet opening and at least one outlet opening, which for example may be closed by curtains. Other closure possibilities or fully opened openings are conceivable. The cleaning system may in particular comprise at least two cleaning zones in the cleaning tunnel. The transport device may be configured to transport the articles to be cleaned on the transport segments sequentially through the cleaning zones. Thus the cleaning zones may for example comprise at least two zones selected from the group consisting of a preliminary clearing zone, a washing zone, a pump-rinsing zone, a fresh-water rinsing zone, a drying zone. Other possibilities are also conceivable.

The cleaning system may in particular also comprise at least one controller. The term "controller" as used here is a broad term which should be given its usual and common meaning as understood by the person skilled in the art. The term is not restricted to a particular or adapted meaning. The term may, without restriction, refer in particular to a one-piece or multipiece device of the cleaning system or cleaning device which is configured to completely or partially control and/or regulate an operation of the cleaning system, in particular the cleaning device and/or the transport system. In particular, the controller may be configured to change, in particular control and/or regulate, one or more operating parameters of the cleaning system, for example at least one temperature, at least one pressure, at least one heating power, at least one transport speed, or also a combination of two or more of said operating parameters. The cleaning device and the transport system may have separate controllers or a common controller, or two or more coupled controllers. The controller may in particular comprise at least one data processing device, for example at least one processor. The controller may in particular be configured by software to control for example at least one cleaning program of the cleaning device, and optionally to control or implement the proposed method in one or more of the following embodiments. The controller configuration may be achieved completely or partially by hardware, or also, alternatively or additionally, completely or partially by software. Furthermore, the controller may comprise at least one volatile and/or non-volatile data memory. Furthermore, the controller may comprise at least one interface, for example a human-machine interface for input of commands and/or output of information, and/or a wireless or hard-wired interface for unidirectional or bidirectional exchange of data and/or commands between the cleaning device and at least one further device. The controller may in particular comprise at least one computer and/or at least one processor. The controller may in particular be a central or to decentral machine controller of the cleaning device and/or the cleaning system and/or the transport system. The controller may in particular be configured by software to control an operation of the transport system and in particular also of the cleaning device. The controller may furthermore also be connected to at least one sensor and for example process one or more sensor signals by software.

As stated above, the controller may be configured in particular by software to control an operation of the cleaning device. The controller may in particular be configured to control a coupling and decoupling of the transport segments to and from the transport device. Alternatively or additionally, this coupling and decoupling may also take place completely without intervention of the controller, for example by purely mechanical intervention.

The controller may in particular be configured to control an operation of the transport device. The controller may for example be configured to control a speed and/or synchronization between at least two transport devices. The controller of the transport device may be identical to a controller of the cleaning device, or alternatively may also be formed separately from the controller of the cleaning device.

In a further aspect, a method is proposed for cleaning articles to be cleaned. The method comprises the steps described in more detail below. These steps may be performed in said order. A different order is however possible in principle. Furthermore, two or more of said method steps may be performed with temporal overlap or simultaneously. Furthermore, one or more of said method steps be carried out once or repeatedly. The method may, in addition to said steps, also comprise further method steps which are not listed.

The method comprises the following steps:

I. providing at least one cleaning system as claimed herein;

II. receiving the articles to be cleaned in the transport segments; and

III. applying at least one cleaning fluid to the articles to be cleaned in the cleaning chamber.

As stated above, the transport segments may be fixedly coupled to the at least one transport device, wherein with respect to the possibilities, reference may be made to the above description of the cleaning system. Alternatively, the transport segments may be coupled to the at least one transport device, for example reversibly. Thus for example the method may comprise at least one method step in which a preferably automatic coupling of the transport segments to the transport device takes place. Furthermore, the method may comprise at least one method step in which a preferably automatic decoupling of transport segments from the transport device takes place.

For further possible embodiments, definitions or options, reference may be made to the above description of the cleaning system.

The at least one transport device may in particular comprise at least one first transport device and at least one second transport device. The transport segments may each be automatically coupled to the first transport device in particular in at least one predefined or predefinable portion of a travel length of a circulation of the transport devices, and automatically coupled to the second transport device in at least one further predefined or predefinable portion of a travel length of the circulation of the transport devices.

In general, the cleaning system described and the method proposed have numerous advantages with respect to known devices and methods of said type. In particular, the technical challenges of known systems and methods as described above are addressed. As stated above, the possible coupling and decoupling of one or more transport segments to the one or more transport devices allows greater flexibility with respect to the design of the cleaning device and with respect to the planning of the operating personnel. In particular, cleaning devices which are intended for cyclic operation can now also be integrated in the cleaning system. The flexibility with respect to location and speed of the transport segments thus allows for example the loading of the cleaning system and the actual cleaning of the articles to be cleaned to be decoupled from one another, such that for example loading may also continue while the articles to be cleaned are stationary inside the cleaning chamber. Furthermore, due to a spacing of transport segments, a spatial and temporal buffer may be created which for example can be used for brief load peaks. As a result, as stated above, more flexible personnel planning may take place. Furthermore, the possibility of coupling to different transport devices allows separate setting of the conditions of delivery transport of dirty articles to be cleaned, the conditions of cleaning in the cleaning chamber, and the conditions of discharge of the cleaned articles, for example with different transport speeds.

To summarize, without restriction of further possible configurations, the following embodiments are proposed.

Embodiment 1: Cleaning system for cleaning articles to be cleaned, comprising:

a) at least one cleaning device comprising at least one cleaning chamber and at least one application device for applying at least one cleaning fluid to the articles to be cleaned in the cleaning chamber; and b) at least one transport system comprising a plurality of transport segments for receiving the articles to be cleaned, wherein the transport segments are guided such that they can be transported through the cleaning chamber in circulation in the transport direction, wherein the transport system furthermore comprises at least one transport device for driving the transport segments.

Embodiment 2: Cleaning system according to the preceding embodiment, wherein the transport device is guided in circulation through the cleaning chamber.

Embodiment 3: Cleaning system according to any one of the preceding embodiments, wherein the transport segments can be automatically coupled to the transport device and automatically decoupled from the transport device.

Embodiment 4: Cleaning system according to any one of the preceding embodiments, wherein the transport system comprises a plurality of transport devices.

Embodiment 5: Cleaning system according to any one of the preceding embodiments, wherein each of the transport devices runs in circulation through the cleaning chamber.

Embodiment 6: Cleaning system according to any one of the two preceding embodiments, wherein the transport segments can be coupled selectively to at least one first transport device or at least one second transport device.

Embodiment 7: Cleaning system according to the preceding embodiment, wherein the cleaning device is configured such that the transport segments can each be coupled alternatively either to the at least one first transport device or to the at least one second transport device.

Embodiment 8: Cleaning system according to any one of the four preceding embodiments, wherein the transport devices are driven independently of one another.

Embodiment 9: Cleaning system according to any one of the five preceding embodiments, wherein the transport devices can be driven with different speeds.

Embodiment 10: Cleaning system according to any one of the six preceding embodiments, wherein the cleaning system is configured such that the transport segments are each coupled to at least one first transport device outside the cleaning chamber and to at least one second transport device inside the cleaning chamber.

Embodiment 11: Cleaning system according to the preceding embodiment, wherein the second transport device is operated discontinuously and configured to halt the transport segments inside the cleaning chamber for predefined or predefinable duration.

Embodiment 12: Cleaning system according to any one of the two preceding embodiments, wherein the cleaning system is configured to open the cleaning chamber on a transfer of the transport segments from the first transport device to the second transport device in order to introduce the transport segments into the cleaning chamber, and wherein the cleaning system is furthermore configured to open the cleaning chamber again on a transfer of the transport segments from the second transport device to the first transport device in order to discharge the transport segments from the cleaning chamber.

Embodiment 13: Cleaning system according to any one of the preceding embodiments, wherein the transport system has at least one first transport segment group and at least one second transport segment group, wherein the first transport segment group and the second transport segment group each comprise at least one transport segment, wherein a first transport device is assigned to the first transport segment group and wherein a second transport device is assigned to the second transport segment group.

Embodiment 14: Cleaning system according to the preceding embodiment, wherein the at least one transport segment of the first transport segment group is fixedly coupled to the first transport device, and wherein the at least one transport segment of the second transport segment group is fixedly coupled to the second transport device.

Embodiment 15: Cleaning system according to any one of the two preceding embodiments, wherein the first transport segment group and the second transport segment group each have a plurality of transport segments, wherein the transport segments of the first transport segment group and of the second transport segment group are each arranged alternately.

Embodiment 16: Cleaning system according to any one of the three preceding embodiments, wherein the first transport device and the second transport device are driven in temporal synchrony.

Embodiment 17: Cleaning system according to any one of the preceding embodiments, wherein the transport segments can be automatically coupled to the transport device and automatically decoupled from the transport device.

Embodiment 18: Cleaning system according to any one of the preceding embodiments, wherein the transport segment and the transport device are configured such that the transport segments are automatically coupled to the transport device in at least one predefined or predefinable portion of a travel length of the circulation of the transport device, and automatically decoupled from the transport device in at least one further predefined or predefinable portion of the travel length of the circulation of the transport device.

Embodiment 19: Cleaning system according to any one of the preceding embodiments, wherein the cleaning system has at least one guide rail, wherein the transport segments are transportable through the cleaning chamber on the guide rail in circulation in the transport direction.

Embodiment 20: Cleaning system according to any one of the preceding embodiments, wherein the transport segments are movable independently of one another, in particular in the transport direction.

Embodiment 21: Cleaning system according to any one of the preceding embodiments, wherein the transport segments are arranged spaced apart from one another such that at least one intermediate space occurs between two of the transport segments along the transport device, in particular along a travel length of the transport device.

Embodiment 22: Cleaning system according to the preceding embodiment, wherein a sum of the lengths of all transport segments along the travel distance is less than the length of the travel distance, in particular by a factor of 0.8 or less, in particular by a factor of 0.7 or less, for example by a factor of 0.5 to 0.66, or less than 0.5.

Embodiment 23: Cleaning system according to any one of the preceding embodiments, wherein the transport segments each comprise a plurality of receiving compartments for the articles to be cleaned.

Embodiment 24: Cleaning system according to any one of the preceding embodiments, wherein the transport device has at least one device selected from the group consisting of a transport belt, a transport chain, a plurality of transport rollers.

Embodiment 25: Cleaning system according to any one of the preceding embodiments, wherein the transport segments and the transport device have co-operating coupling elements, wherein the coupling elements are configured to be coupled together, preferably reversibly.

Embodiment 26: Cleaning system according to the preceding embodiment, wherein the cleaning system has at least one first spatial region in which the transport device is moved away from the guide of the transport segments so that decoupling takes place.

Embodiment 27: Cleaning system according to any one of the two preceding embodiments, wherein the cleaning system has at least one second spatial region in which the transport device is moved towards the guide of the transport segments so that coupling takes place.

Embodiment 28: Cleaning system according to any one of the three preceding embodiments, wherein the coupling elements are fully or partially movable.

Embodiment 29: Cleaning system according to any one of the four preceding embodiments, wherein the coupling elements have at least one element selected from the group consisting of a carrier and a transport hook.

Embodiment 30: Cleaning system according to any one of the preceding embodiments, wherein the cleaning system comprises at least one dishwashing machine.

Embodiment 31: Cleaning system according to the preceding embodiment, wherein the dishwashing machine is selected from the group consisting of a basket transport dishwasher, a belt transport dishwasher, a pass-through dishwasher.

Embodiment 32: Cleaning system according to any one of the preceding embodiments, wherein the cleaning chamber is configured at least partially as a cleaning tunnel.

Embodiment 33: Cleaning system according to any one of the preceding embodiments, wherein the cleaning system has at least two cleaning zones in the cleaning tunnel, wherein the transport device is configured to transport the articles to be cleaned on the transport segments sequentially through the cleaning zones.

Embodiment 34: Cleaning system according to the preceding embodiment, wherein the cleaning zones comprise at least two zones selected from the group consisting of a preliminary clearing zone, a washing zone, a pump-rinsing zone, a fresh-water rinsing zone, a drying zone.

Embodiment 35: Cleaning system according to any one of the preceding embodiments, wherein the cleaning system furthermore comprises a controller, wherein the controller is configured by software to control an operation of the cleaning device.

Embodiment 36: Cleaning system according to the preceding embodiment, wherein the controller is configured to control a coupling and decoupling of the transport segments to and from the transport device.

Embodiment 37: Cleaning system according to any one of the two preceding embodiments, wherein the controller is configured to control an operation of the transport device.

Embodiment 38: Method for cleaning articles to be cleaned, comprising the following method steps:

I. providing at least one cleaning system according to any one of the preceding embodiments;

II. receiving the articles to be cleaned in the transport segments; and

III. applying at least one cleaning fluid to the articles to be cleaned in the cleaning chamber.

Embodiment 39: Method according to the preceding embodiment, wherein the at least one transport device comprises at least one first transport device and at least one second transport device, wherein the transport segments are each automatically coupled to the first transport device in at least one predefined or predefinable portion of a travel length of a circulation of the transport devices, and automatically coupled to the second transport device in at least one further predefined or predefinable portion of a travel length of a circulation of the transport devices.

BRIEF DESCRIPTION OF THE FIGURES

Further details and features arise from the following description of exemplary embodiments, in particular in connection with the subclaims. Here, the respective features may be implemented alone or combined with one another in groups. The invention is not restricted to the exemplary embodiments. The exemplary embodiments are depicted schematically in the figures. The same reference signs in the individual figures designate the same elements or those of similar function or with mutually corresponding function.

The drawings show.

DESCRIPTION OF EXEMPLARY EMBODIMENTS

Figure 1:
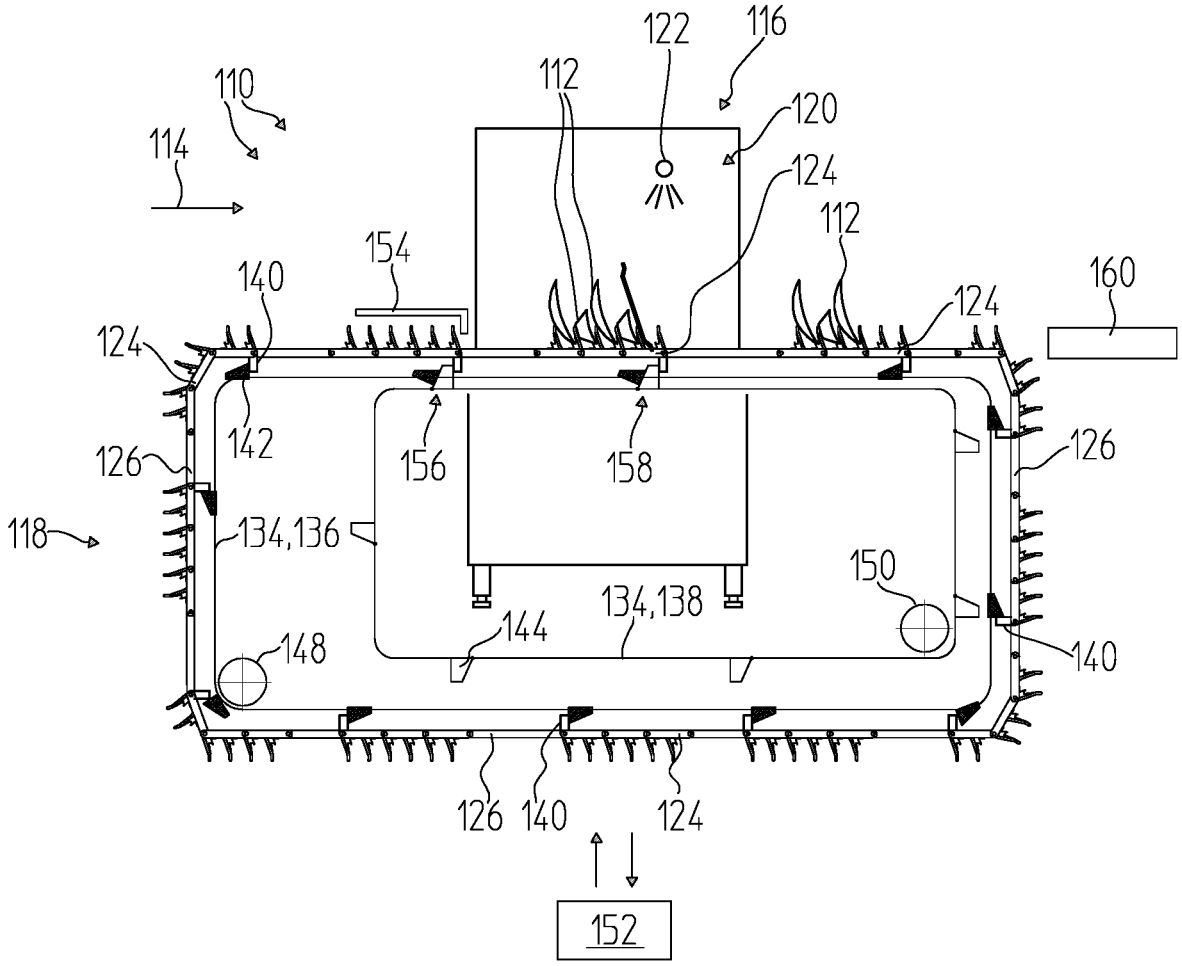
FIG. 1 a first exemplary embodiment of a cleaning system for cleaning articles to be cleaned, in a sectional depiction from the side.

FIG. 1 shows a first exemplary embodiment of a cleaning system 110 for cleaning articles 112 to be cleaned, in a sectional depiction from the side, with a section plane parallel to a transport direction 114. The cleaning system 110 comprises a cleaning device 116 and a transport system 118.

The cleaning device 116 comprises a cleaning chamber 120 in which at least one cleaning fluid can be applied to the articles 112 to be cleaned by means of an application device 122. The cleaning device 116 may be configured for example as a programmable machine, wherein the articles 112 to be cleaned remain stationary in the cleaning chamber 120 during cleaning. By way of assistance, the cleaning device 116 may accordingly be configured as a pass-through dishwasher, for example in the form of a hood dishwasher, wherein a hood of the cleaning chamber 120 may be opened for loading and unloading the articles 112 to be cleaned, and closed again for the cleaning. Alternatively, the cleaning device 116 may also be configured such that the articles 112 to be cleaned remain in motion during cleaning and application of the cleaning fluid, and are transported for example through the cleaning chamber 120. Accordingly, the cleaning device 116 may for example comprise a transport dishwasher. For possible designs of such dishwashers, reference may be made for example to the above-mentioned prior art, apart from the transport system 118 which is described in more detail below.

Figure 2:
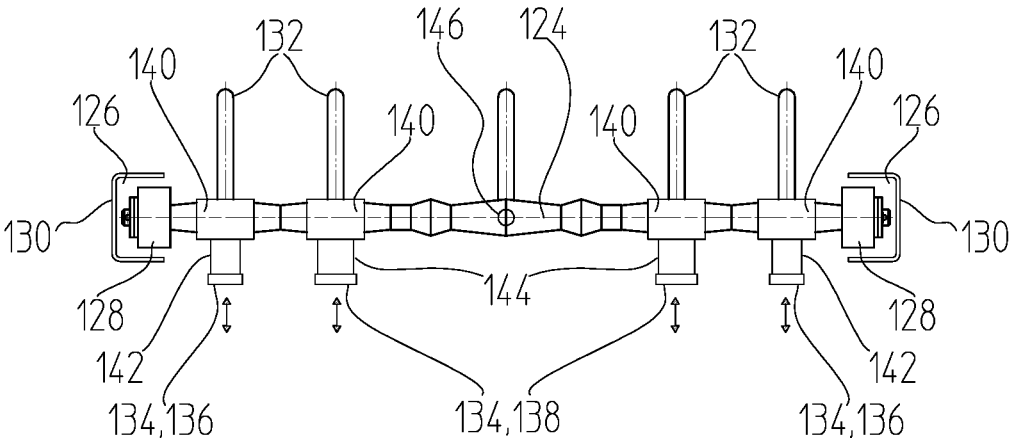
FIG. 2 a sectional illustration through a transport segment and its guide, with section plane perpendicular to the drawing plane of FIG. 1.

In the exemplary embodiment depicted, the transport system 118 comprises a plurality of transport segments 124. The transport segments 124 are for example mounted to slide or roll independently of one another in a guide 126. For example, the guide 126 may comprise a rail system. FIG. 2 shows as an example a sectional illustration, perpendicularly to the drawing plane in FIG. 1, through a transport segment 124 and its guide 126. Thus the transport segment 124 may comprise for example a plurality of lateral transport rollers 128 which may be mounted so as to roll in rail elements 130. A sliding mounting is also possible. The transport segments 124 may for example comprise a plurality of fingers 132 on the top side, in which the articles 112 to be cleaned may be inserted. The guide 126 is configured such that the transport segments 124 can be guided through the cleaning chamber 120 in circulation in the transport direction 114. For example, the guide 126 may comprise a closed rail system, so that for example the transport segments 124 in FIG. 1 may be guided clockwise in circulation.

In the exemplary embodiment shown in FIG. 1, the cleaning device 116 furthermore comprises as an example two transport devices 134, namely a first transport device 136 and a second transport device 138. Also only one transport device 134, or also more than two transport devices 134, may be provided. The transport devices 134, as shown in FIG. 1, are preferably guided in circulation so that they may each guide the transport segments 124 in circulation through the cleaning chamber 120. The transport segments 124 may each be couplable reversibly to the transport devices 134. Thus the transport segments 124 may for example each be automatically coupled either to the first transport device 136 or to the second transport device 138, as will be described in more detail below.

The transport segments 124 each comprise for example coupling elements 140, for example in the form of hooks. These hooks may be rigidly formed or for example foldable. The transport devices 134 in turn have corresponding coupling elements 142, 144 which can engage in the coupling elements 140 of the transport segments 124. As evident in the cross-sectional depiction in FIG. 2, the transport devices 136, 138 may for example each comprise drive chains or drive belts, from which the coupling elements 142 or 144 protrude upwards. By corresponding guidance of the transport devices 136, 138 relative to the guide 126 of the transport segments 124, depending on the location of the respective transport segment 124, the coupling elements 142 and/or 144 may each be brought into engagement with the respective coupling elements 140 of a transport segment 124. For example, in this exemplary embodiment, two coupling elements 140 are provided on each transport segment 124 for engagement with corresponding coupling elements 142 of the first transport device 136, and two coupling elements 140 are provided for engagement with corresponding coupling elements 144 of the second transport device 138. These may for example be arranged symmetrically to the right and left of axis 146 of the transport segments 124, so that a tilting of the transport segments 124 in the guide 126 is avoided by the symmetrical force application. In order to bring the coupling elements 142, 144 optionally into engagement with the corresponding coupling elements 140, the transport devices 136, 138 may be guided for example such that either the coupling elements 142 or the coupling elements 144 are brought to the respective coupling elements 140. For decoupling, the coupling elements may for example be moved relatively away from the coupling elements 140 again by corresponding guidance of the transport devices 136, 138.

The transport devices 136, 138 may for example be driven via a common drive or, as shown as an example in FIG. 1, by separate drives 148, 150, for example by corresponding motors, in particular electric motors. If several drives are provided, these may for example be synchronized, in particular by means of at least one controller 152 of the cleaning system 110. The controller 152 may for example be a central machine controller, which for example may also activate an operation of the cleaning device 116, so that for example one or more cleaning programs may be activated by means of the controller 152. Alternatively, the controller 152 may also comprise several sub-controllers, for example a controller for the cleaning device 116 and a controller for the transport system 118.

The transport devices 136, 138 may for example be operated with different speeds. Actuation cycles are also possible in which the transport devices 136, 138 are operated with a corresponding speed depending on the respective requirement. Operation may take place for example such that, for example by means of the first transport device 136, a transport segment 124 is transported to a loading position in front of the cleaning chamber 120, in order there to be loaded with articles 112 to be cleaned, either manually or by means of a loading device 154. Then, for example at a changeover position 156, the first transport device 136 may be decoupled from the transport segment 124, for example in that the coupling elements 142 are moved away from the associated coupling elements 140 of the transport segment 124 by a corresponding guide. At the same time or with a temporal offset, corresponding coupling elements 144 of the second transport device 138 may be brought into engagement with associated coupling elements 140 of the transport segment 124, for example in that these coupling elements 144 are moved relatively towards the coupling elements 140 of the transport segment 124 by a corresponding guide. By means of the second transport device 138, for example after opening of the cleaning chamber 120, in particular by opening a hood and/or by passing through a corresponding inlet opening, the transport segment 124 in question, together with the articles 112 to be cleaned, may be brought into the cleaning chamber 120. There, depending on the design of the cleaning device 116, the transport segment 124 may remain stationary for the duration of a cleaning program or be transported with constant or varying speed through the cleaning chamber 120, for example through several cleaning zones in the cleaning chamber 120. At a further changeover position 158, then for example again a change between transport devices 134 may take place. Thus for example the second transport device 138 may again be decoupled from the transport segment 124, for example in that the coupling elements 144 are moved relatively away from the transport segment 124 by a corresponding guide, so that they are decoupled from the associated coupling elements 140. At the same time or with a temporal offset, for example again by a corresponding guide, the coupling elements 142 may again be brought towards the associated coupling elements 140 and thus brought into engagement therewith. Then, for example by means of the first transport device 136, in particular after opening the cleaning chamber 120 and/or after passing through a corresponding outlet opening of the cleaning chamber 120, the respective transport segment 124 is moved out of the cleaning chamber 120. There, the cleaned articles 112 may be removed from the transport segment 124, for example manually or by means of a corresponding unloading device 160. The now unloaded transport segment 124 may be guided in circulation again up to the loading device 154, for example by means of the first transport device 136.

As shown as an example in FIG. 1, the transport segments 124 may always each be coupled to one of the transport devices 134 or also to both transport devices 134. However other embodiments are conceivable in which the transport segments 124 are completely decoupled from the transport devices 134 in circulation along the travel distance of the transport segments 124 predefined by the guide 126. These one or more decoupling sections may for example be used for storage of transport segments 124. When the transport segments 124 are required again, they may again be coupled, for example automatically or manually, to one or more of the transport devices 134.

Figure 3:
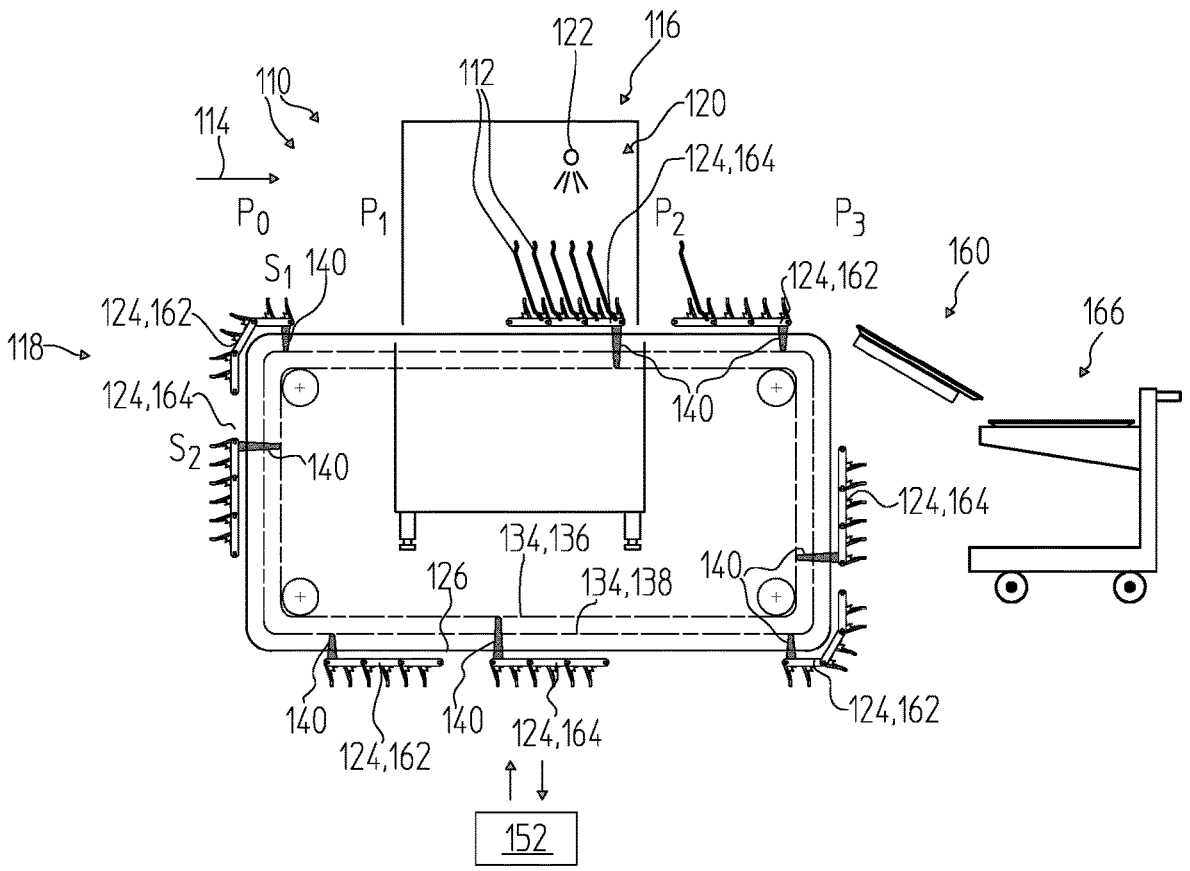
FIG. 3 a derivative of the cleaning system according to FIG. 1.

FIG. 3 shows as an example a derivative of the clean system 110 according to FIG. 1. To a great extent, reference may be made to the description of the exemplary embodiment of FIG. 1. In this exemplary embodiment however, it is shown that the transport segments 124 need not necessarily be reversibly coupled to the at least one transport device 134.

In this exemplary embodiment, again two transport devices 136, 138 are provided, which are configured to transport the transport segments 124 in circulation through the cleaning chamber 120 of the cleaning device 116. The transport devices 136, 138 may again be driven by one or more drives. If separate drives are provided for the transport devices 136, 138, these may in particular be operated in synchrony.

In this exemplary embodiment, the transport segments 124 are divided for example into two transport segment groups, namely a first transport segment group 162 and a second transport segment group 164. The transport segments 124 of the first transport segment group 162 are coupled by means of coupling elements 140 to the first transport device 136, and the transport segments 124 of the second transport segment group 164 are coupled via corresponding coupling elements 140 to the second transport device 138. In particular, the transport segments 124 of the two transport segment groups 162, 164 may be arranged alternately and again guided in circulation for example by means of a guide 126.

The transport devices 136, 138 may be operated for example in synchrony, but each with different speed profiles. As an example, this is indicated schematically in FIG. 4 by means of the speeds v of a segment S1 of the first transport segment group 162 and of a segment S2 of the second transport segment group 164, as a function of time t. For both speed profiles, the positions of the leading edges of the respective transport segments S1, S2 are shown, marked in FIGS. 3 and 4 as $P_0$, $P_1$, $P_2$ and $P_3$. Furthermore, times $t_0$, $t_1$, $t_2$, $t_3$ and $t_4$ are shown on the time axis t.

The cleaning system 110 may also comprise one or more position sensors, for example position switches, which can determine the position of individual or several transport segments 124 and/or which may be configured to determine whether a transport segment 124 has reached at least one specific position.

Thus for example a transport segment S1 may be moved with a medium speed up to point $P_0$, which the transport segment S1 reaches at time to. There, manual or automatic loading with articles 112 to be cleaned may take place, similarly to FIG. 1, until at time $t_1$ the leading edge reaches point $P_1$, which for example may mark the end of a loading zone. There the transport segment S1 may for example be brought, after opening of the cleaning chamber 120 and/or through an inlet opening, into the cleaning chamber 120 until the leading edge, for example at time $t_2$, has reached point $P_2$ and is completely received in the cleaning chamber 120. The transport segment S1 may for example remain there with speed v=0 while a cleaning program runs in the cleaning device 116. Alternatively, the cleaning device 116 may be configured such that the transport segment S1 is transported with a transport speed through one or more cleaning zones of the cleaning device 116 where it is cleaned. The process of cleaning the articles to be cleaned on the transport segment S1 may for example take place during a time interval Δt. After the end of the cleaning program, for example at time $t_3$, the speed v of the first transport device 136 may be increased again and the transport segment S1, for example at time $t_4$, reaches point $P_3$. There unloading may be provided, for example again manually or also automatically, for example via an unloading device 160. As an example, here unloading onto a tray trolley 166 is shown.

Figure 4:
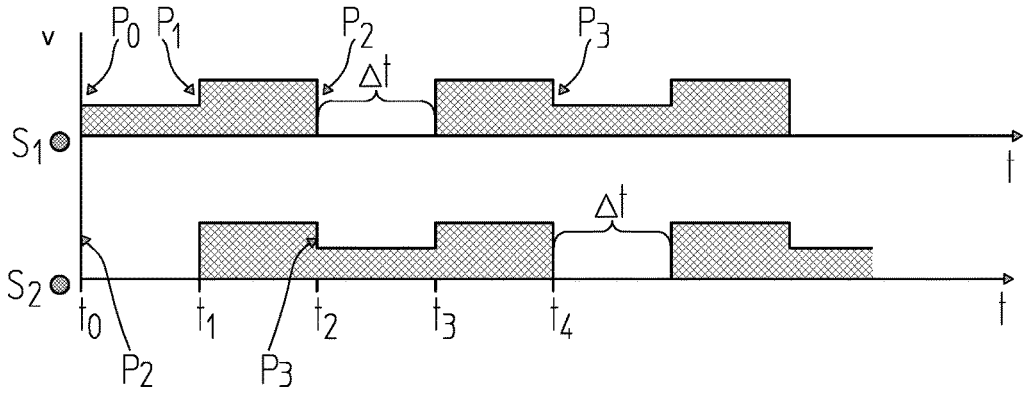
FIG. 4 exemplary temporal profiles of the speeds of the two transport devices of the cleaning system in FIG. 3.

The drive configuration, shown at the bottom in FIG. 4, for the second transport device 138 for transporting the transport segments S2 of the second transport segment group 164 may for example be identical to the drive configuration of the first transport segment group 162, but with a time offset. Thus for example, at time to, a transport segment S2 may be present in the cleaning chamber 122 with leading edge at point $P_2$. At time $t_1$, the cleaning program for the articles 112 to be cleaned on the transport segment S2 is completed, and the transport segment S2 is moved out of the cleaning chamber 120 at high speed until, at time $t_2$, it reaches point $P_3$ where it is unloaded. Then it may be transported further at medium speed until time $t_3$ at which the cleaning program for the following transport segment S1 of the first transport segment group 162 has ended, whereupon both transport devices 136, 138 are operated at high speed until time $t_4$.

Then the speed profiles of the two transport devices 136, 138 may be repeated periodically. Thus in general the time profiles of the transport devices 136, 138 may be configured periodically with a phase shift. In general, the number of segments of the temporal profile of the speeds may be adapted to the respective circumstances. It is also not absolutely necessary to keep the speeds constant in portions, but temporal variations of the transport speeds may be provided in one or more portions.

LIST OF REFERENCE SIGNS

110 Cleaning system
112 Articles to be cleaned
114 Transport direction
116 Cleaning device
118 Transport system
120 Cleaning chamber
122 Application device
124 Transport segment
126 Guide
128 Transport roller
130 Rail element
132 Finger
134 Transport device
136 First transport device
138 Second transport device
140 Coupling element
142 Coupling element
144 Coupling element
146 Axis
148 Drive
150 Drive
152 Controller
154 Loading device
156 Changeover position
158 Changeover position
160 Unloading device
162 First transport segment group
164 Second transport segment group
166 Tray trolley

The invention claimed is:

1. A cleaning system for cleaning articles to be cleaned, comprising:

a) at least one cleaning device, comprising at least one cleaning chamber and at least one application device for applying at least one cleaning fluid to the articles to be cleaned in the cleaning chamber; and b) at least one transport system, comprising a plurality of transport segments for receiving the articles to be cleaned, wherein the transport segments are guided such that they can be transported through the cleaning chamber in circulation in a transport direction, wherein the transport system furthermore comprises at least one transport device for driving the transport segments, wherein the at least one transport device comprises at least one first transport device and at least one second transport device, wherein the cleaning system is configured such that the transport segments are each automatically coupled to the first transport device in at least one predefined or predefinable portion of a travel length of a circuit of the transport devices, and automatically coupled to the second transport device in at least one further predefined or predefinable portion of the travel length of the circuit of the transport devices.

2. The cleaning system as claimed in claim 1, wherein the transport segments can be automatically coupled to the transport device and automatically decoupled from the transport device.

3. The cleaning system as claimed in claim 1, wherein the transport segments can be coupled selectively to at least one first transport device or to at least one second transport device.

4. The cleaning system as claimed in claim 1, wherein the cleaning system is configured such that the transport segments are each coupled to at least one first transport device outside the cleaning chamber and coupled to at least one second transport device inside the cleaning chamber.

5. The cleaning system as claimed in claim 4, wherein the second transport device is operated discontinuously, and is configured to halt the transport segments inside the cleaning chamber for a predefined or pre-definable duration.

6. The cleaning system as claimed in claim 1, wherein the cleaning system is configured to open the cleaning chamber on a transfer of the transport segments from the first transport device to the second transport device, in order to introduce the transport segments into the cleaning chamber, and wherein the cleaning system is furthermore configured to open the cleaning chamber again on a transfer of the transport segments from the second transport device to the first transport device, in order to discharge the transport segments from the cleaning chamber.

7. The cleaning system as claimed in claim 1, wherein the transport system has at least one first transport segment group and at least one second transport segment group, wherein the first transport segment group and the second transport segment group each have at least one transport segment, wherein a first transport device is assigned to the first transport segment group and wherein a second transport device is assigned to the second transport segment group.

8. The cleaning system as claimed in claim 1, wherein the cleaning system comprises at least one guide rail, wherein the transport segments can be transported through the cleaning chamber on the guide rail in circulation in the transport direction.

9. The cleaning system as claimed in claim 1, wherein the transport segments are movable independently of one another.

10. The cleaning system as claimed in claim 1, wherein the transport device comprises at least one device selected from the group consisting of a transport belt, a transport chain, a plurality of transport rollers.

11. The cleaning system as claimed in claim 1, wherein the transport segments and the transport device have cooperating coupling elements, wherein the coupling elements are configured for coupling to one another.

12. The cleaning system as claimed in claim 1, wherein the cleaning system comprises at least one dishwashing machine.

* * * * *